US007025532B2

(12) United States Patent
Suazo et al.

(10) Patent No.: US 7,025,532 B2
(45) Date of Patent: Apr. 11, 2006

(54) APPARATUS AND METHOD FOR TRANSPORTING WATER WITH LINER

(75) Inventors: Kenneth L. Suazo, Vallecitos, NM (US); Isaac Suazo, Vallecitos, NM (US); Annabelle Suazo, Vallecitos, NM (US); Dawn Suazo Daugherty, Tijeras, NM (US); Juan Griego, Vallecitos, NM (US); Julian Suazo, Vallecitos, NM (US)

(73) Assignee: Fast Ditch, Inc., Espanola, NM (US)

( * ) Notice: Subject to any disclaimer, the term of this patent is extended or adjusted under 35 U.S.C. 154(b) by 0 days.

(21) Appl. No.: 10/731,315

(22) Filed: Dec. 8, 2003

(65) Prior Publication Data

US 2004/0115001 A1 Jun. 17, 2004

Related U.S. Application Data

(62) Division of application No. 10/316,756, filed on Dec. 11, 2002, now Pat. No. 6,692,186.

(51) Int. Cl.
*E02B 5/00* (2006.01)
*E02B 13/00* (2006.01)

(52) U.S. Cl. ..... 405/36; 405/39; 405/49; 405/118; 405/120; 405/121; 404/2; 210/170; 210/747

(58) Field of Classification Search ..... 405/36, 405/39, 46, 118–123, 40, 270; 404/2–4; 52/11, 12, 16; 403/300, 305; 210/170, 747
See application file for complete search history.

(56) References Cited

U.S. PATENT DOCUMENTS

| | | | | |
|---|---|---|---|---|
| 3,446,025 | A * | 5/1969 | Koch | 405/43 |
| 3,926,222 | A * | 12/1975 | Shroy et al. | 405/49 |
| 6,141,916 | A * | 11/2000 | Shackelford | 52/12 |
| 6,202,358 | B1 * | 3/2001 | Janesky | 52/16 |
| 6,450,458 | B1 * | 9/2002 | Bernard | 52/11 |
| 6,722,818 | B1 * | 4/2004 | Suazo et al. | 405/121 |
| 2002/0094238 | A1 * | 7/2002 | Schibi | 405/118 |

FOREIGN PATENT DOCUMENTS

JP 07292893 * 11/1995

* cited by examiner

*Primary Examiner*—Jong-Suk (James) Lee
(74) *Attorney, Agent, or Firm*—Ray R. Regan

(57) ABSTRACT

An apparatus and method for lining ditches is provided. The apparatus and method for lining ditches, according to the present invention, includes a plurality of substantially corrugated liner sections, preferably made of a thermoplastic material such as polyethylene. Each liner section is designed to be assembled by detachably engaging ends of ditch liner sections. A sealant that does not bond with the material from which the liner sections are made may also be included. An inlet/outlet channel is included. The inlet/outlet channel is removably connectable with at least one end of a liner section by snapping together the two components. A liner section in the form of a splitter section also is provided. A splitter section permits rerouting the flow of water in a variety of directions through a ditch lined with the apparatus of the present invention. Also, a diverter section is included for diverting water from one flow direction through the ditch to a point or area of application of water. In addition, an adaptor also is included. An adaptor may be used to interconnect incompatible liner sections.

5 Claims, 15 Drawing Sheets

APPARATUS AND METHOD FOR TRANSPORTING WATER WITH LINER

CROSS-REFERENCE TO RELATED APPLICATION

This application is a divisional application of U.S. application Ser. No. 10/316,756 filed on Dec. 11, 2002, for which U.S. Pat. No. 6,692,186 B1 issued on Feb. 17, 2004.

FIELD OF THE INVENTION

The present invention pertains generally to transportation of water. More particularly, the new and useful invention claimed in this document pertains to a ditch liner system for conveying water through earthen irrigation ditches. The present invention is particularly, but not exclusively, useful for providing both an apparatus and method for detachably connecting liner sections by snapping liner section ends together to secure individual sections to form a ditch liner system within a ditch. The present invention also is useful for directing water flow into, among, and from interconnected ditch liner sections and ditches in such a way as to reduce water loss during transportation of water through the system of ditch liners practiced in accordance with the present invention.

BACKGROUND OF THE INVENTION

Ditches formed in the earth for conveying water to a point or area of use have been common for generations throughout the world. Ditches have been used to transport both potable and irrigation water. Earthen irrigation ditches continue to be significant transporters of water, particularly to convey surface irrigation water to crops. As used in this document, the term "ditch" includes any excavation dug in the earth that may be referred to as a drain, channel, canal or acequia. Earthen ditches, relying on principles of gravity flow to transport water along descending elevations of a ditch, continue to be popular because they provide low-cost irrigation systems.

During transportation of water through earthen ditches unlined by a material other than dirt, significant quantities of that ever more precious commodity, water, are lost because of seepage, erosion, trans-evaporation and other causes. Tests indicate that as much as 80–90% of water may be lost during transportation through an unlined earthen ditch before water is delivered to a point or area for application and use.

Accordingly, a number of approaches, suggestions and means for lining earthen ditches have been proposed or suggested. At least one prior approach for lining earthen ditches includes concrete. Concrete, however, is expensive to install, is substantially permanent, and requires erection of forms into which concrete must be formed to create necessary shapes. Other proposals for lining ditches have included use of various forms of metal, most often alloys of steel. Metal liners, however, have proven too rigid, too heavy to install easily, and unacceptable for a variety of environmental reasons. Polyvinyl chloride ("PVC") also has been used, but in many locales liners made of PVC must be buried beneath ground because of environmental concerns.

Additional limitations of those prior approaches to transporting water through earthen ditches are significant. Not only are large quantities of water lost through seepage, erosion and evaporation, but unlined earthen ditches must constantly be maintained, cleaned and repaired to avoid further loss of water through wall collapse, accumulated debris, absorption through dirt walls, and capillary action. Repair and maintenance of ditches is costly and labor intensive. Limitations of prior approaches that involved lining earthen ditches with a variety of materials such as concrete, metal and more recently one or more forms of polyvinyl chloride materials, are expensive and unresponsive to modern environmental concerns. Such materials have proven difficult to install in remote geographical areas, inflexibly positioned once installed, and often require major construction efforts often neither practical nor affordable. Such materials also do not allow making component ditch parts that snap together to form a detachable but locked joint. Inability to readily direct and redirect water flow to other ditches or in other directions using concrete or steel also is a significant limitation on their use.

An exemplary solution to problems associated with lining earthen ditches was provided by one of the present inventors in U.S. Pat. No. 6,273,640 B1, issued to Kenneth L. Suazo on Aug. 14, 2001 ("Suazo Patent"). The Suazo Patent provided an irrigation ditch liner system comprising a plurality of liner sections that are sem-cylindrical in shape and employ a sem-cylindrical connector piece to connect liner sections along the course of a ditch.

To appreciate the additional advantages of the present invention, it is important first to appreciate the significant distances that an interconnected system of liner sections may traverse in a field environment during use and operation of the present invention. Ditch lengths exceeding five thousand feet are not uncommon. In many field environments, the rate at which water flows through a ditch also is significant. Frequently, a ditch master, or similar official, notifies a property owner when water for irrigation has been released upstream. It thereafter becomes the responsibility of the ditch owner to secure the allotment of water before it passes downstream.

It also should be appreciated that loss of water, commonly referred to as "seepage loss," may be considerable. At least one report issued by New Mexico State University entitled "Field/laboratory Studies for the FastDitch Lining System," dated Feb. 10, 2002 ("Report"), indicates the results of tests conducted over a nine day interval. Total water losses during the nine day test period were estimated to be 14,245,010 gallons, or 85.8% of total flow, when water was conducted through an unlined earthen ditch. The report attributes most water losses to existing vegetation overgrowth, tree root systems, gopher holes, evaporation, and seepage or percolation. On the other hand, that same report, based on field measurements taken with the liner system disclosed in the Suazo Patent installed in the same earthen ditch, showed a total loss of only 7.3% of total flow.

The present invention seeks to eliminate even that small amount of seepage loss. Further optimizations in connection with the Suazo Patent may be achieved as provided in connection with the present invention by providing alternative features and elements desirable for increasing the range and variety of differing applications and environments in which the present invention may be used. As indicated, a previously unaddressed need exists for a new, useful and improved apparatus and method for lining ditches that is easy to install, lightweight, will transport water efficiently at larger than customary flow rates while also reducing loss of water during conveyance, and will reduce maintenance problems that accompany insiltation, cleaning and maintenance of conventional earthen ditches and ditch liners.

SUMMARY OF THE INVENTION

Given the conventional solutions for attempting to solve problems associated with conventional ditch liners, it would be desirable, and of considerable advantage, to provide an apparatus and method for transporting water through an earthen ditch that is lightweight, easy to install with readily available common tools and equipment, is capable of transporting water efficiently at larger than normal or conventional flow rates, yet significantly reduces water loss during transportation of water through a system of ditch liners. It would also be desirable to provide an apparatus and method for transporting water through an earthen ditch that is comparatively less expensive, is aesthetically pleasing in the operative environment, is environmentally friendly, and requires no unique skills to assemble, install, and maintain.

The present invention provides numerous advantages in connection with an apparatus and method for transporting water through an earthen ditch. At least one advantage of the present invention is that it provides an apparatus and method for lining ditches that is manufactured and constructed of materials that are environmentally safe, non-toxic, and completely recyclable.

Yet another advantage of the present invention is a unique feature that allows liner sections to be snapped together for assembly into a ditch liner system. Any number of various and varying liner sections formed with locking channel segments in accordance with the present invention may be assembled into a system for transporting water through a ditch. The handle assemblies also facilitate ease of assembly of ditch liner sections while on the bank of a ditch, rather than in the ditch. When snapped together, the ditch liner sections are removably locked together and will remain detachably interconnected until snapped apart or unlocked. Snapped together locking channel segments, in accordance with the present invention, form a substantially water tight seal between locking channel segments. Snapped together locking channel segments therefore substantially eliminate loss of water through seepage and similar causes of water losses.

The advantages obtained because of the capability of snapping together and snapping apart a number of ditch liner sections also permit assembly of a series of interconnected ditch liner sections before installation of an assembled ditch liner assembly in a ditch. As used in this document, the terms "ditch liner section," "liner section," "liner," and "section" mean, without limitation, the components described in this document that may be removably connected to form the apparatus, method and system for transporting water in accordance with the present invention. The terms therefore include a ditch liner section, an inlet/outlet box or channel, a diversion section, an adaptor, and a splitter section as described and claimed in this document.

Another advantage of the present invention is its ability to transport water efficiently and at larger than customary flow rates, while reducing ditch insiltation, cleaning and maintenance, while significantly reducing water loss.

Yet another advantage of the present invention is its capability to withstand climate and temperature changes, as well as puncture shear from domestic and wild animals.

Still another advantage of the present invention is its low cost of installation, particularly in comparison with traditional materials used to line earthen ditches such as concrete, metal, and PVC materials.

Another advantage of the present invention is its flexible capability to adapt to the contour and configuration of already extant generally meandering ditches and ditch interconnections, and to connect open ends of ditches that might otherwise be unconnectable.

Still another advantage of the present invention is its capability to inexpensively and readily divert flows of water in different directions as needed not only based on the course and courses of interconnected ditches, but also to efficiently deliver the water at the proper place for irrigation.

Another advantage of the present invention is that it provides unique apparatus and methods for interconnecting the sections of the liner system, which also contributes to reducing seepage, flow stoppage and other losses of water at the point of connection or joint between liner sections.

Yet another object of the present invention is to provide a transportable, flexible, and light weight ditch liner system that can be installed either in existing or newly constructed irrigation gravity flow ditches and laterals.

Another advantage of the present invention is that its light weight allows preassembly of a number of ditch liner sections before placement in the ditch.

Yet another advantage of the apparatus and method for transporting water through an earthen ditch is the capability to reroute selected ditch liner sections, and therefore the water that the selected ditch liner sections transport, through a wide range of changes in direction.

Another advantage of the present invention is to channel water into and from an assembly of ditch liner sections.

Still another advantage of the present invention is the capability to attach together dissimilar or incompatible ditch liner sections by use of an adaptor.

Another advantage of the system for transporting water through an earthen ditch is the capability of diverting water from the system to flow in a different direction.

Yet another advantage of the present invention is an apparatus and method for lining ditches, according to the present invention, which respectively are easy to use and to practice, and cost effective for their intended purposes.

These and other advantages of the present invention are achieved by providing a plurality of ditch liner sections, preferably substantially corrugated, and preferably substantially made of polyethylene. Each liner section is designed to be assembled either by snapping together ends of the ditch liner sections, or by interposing an adaptor formed to snap together sections with incompatible locking channel segments as defined below. The terms "snap together," and variations of those terms as used in this document, refer to the feature and capability of locking channel segment on the end of a liner section to lock together with a locking channel segment on another liner section to form a substantially leak-free seal, and to remain detachably connected during use. A sealant that does not bond with the material used to make the ditch liner sections, referred to as "nonbonding," may also be included.

The apparatus, method and system for transporting water, in accordance with the present invention, also includes an inlet/outlet channel. The inlet/outlet channel is demountably engageable with at least one locking channel segment in at least one end of a liner section. The inlet/outlet channel is provided to make a smooth transition of water flow either from a water source into a ditch or from a ditch. In addition, a liner section in the form of a splitter section is provided. A splitter section permits rerouting the flow of water in different directions through a ditch lined with the apparatus of the present invention. A splitter also allows direction and redirection of water flow through one or more ditches despite a wide range of changes in water flow direction.

Also, a diverter section is included for diverting water from one flow direction through the ditch to a point or area of application of the water.

An adaptor also is included. An adaptor maybe used to connect incompatible liner sections. As used in this document, the term "incompatible liner sections" or "incompatible locking channel segments" means that one or more locking channel segments when positioned for assembly does mate with the next locking channel segment on another liner section. The two incompatible locking channel segments may not be snappably engageable because both locking channel segments may be male locking channel segments, or both may be female locking channel segments. Incompatibility of locking channel segments may occur due to the configuration of a ditch or system of ditches, or because the combinations and permutations of various liner sections used to construct a system for transporting water through a ditch or system of ditches interposes incompatible locking channels. The problem of incompatible locking channel segments is solved in the present invention by use of an adaptor. The adaptor is formed to accommodate interconnection of incompatible locking channel segments.

The present invention, therefore, is useful for forming a system for transporting water through a ditch that substantially eliminates water seepage, is sufficiently lightweight to be easily assembled and placed into an earthen ditch, and may be disassembled for relocation, repair, or other purpose, yet remains fixed in the ditch during operation and use.

The foregoing has outlined broadly the more important features of the invention to better understand the detailed description which follows, and to better understand the contribution of the present invention to the art. Before explaining at least one embodiment of the invention in detail, it is to be understood that the invention is not limited in application to the details of construction, and to the arrangements of the components, provided in the following description or drawing figures. The invention is capable of other embodiments, and of being practiced and carried out in various ways. Also, the phraseology and terminology employed in this disclosure are for purpose of description, and should not be regarded as limiting.

It will become apparent to one skilled in the art that the claimed subject matter as a whole, including the structure of the apparatus, and the cooperation of the elements of the apparatus, combine to result in a number of unexpected advantages and utilities. The advantages and objects of the present invention, and features of such an apparatus and method for lining a ditch, will become apparent to those skilled in the art when read in conjunction with the accompanying following description, drawing figures, and appended claims.

As those skilled in the art also will appreciate, the conception on which this disclosure is based readily may be used as a basis for designing other structures, methods, and systems for carrying out the purposes of the present invention. The claims, therefore, include such equivalent constructions to the extent the equivalent constructions do not depart from the spirit and scope of the present invention. Further, the abstract associated with this disclosure is neither intended to define the invention, which is measured by the claims, nor intended to be limiting as to the scope of the invention in any way.

The novel features of this invention, and the invention itself, both as to structure and operation, are best understood from the accompanying drawing, considered in connection with the accompanying description of the drawing, in which similar reference characters refer to similar parts, and in which:

DESCRIPTION OF A PREFERRED EMBODIMENT

Briefly, the present invention provides an apparatus and method for lining ditches. In a preferred embodiment of the present invention, the apparatus and method for lining ditches includes a plurality of substantially corrugated ditch liner sections that are substantially semi-cylindrical in shape. In a preferred embodiment of the present invention, the plurality of substantially corrugated ditch liner sections are made of polyethylene. The plurality of ditch liner sections are designed to be assembled by snapping together opposing ends of the ditch liner sections. Snapping together the ditch liner sections results in a detachably locked together series of liner sections. A sealant that does not bond with the ditch liner sections may also be included.

In a preferred embodiment of the present invention, an inlet/outlet channel is included. The inlet/outlet channel is detachably and removably engageable with at least one end of a ditch liner section. The inlet/outlet channel is provided to make a smooth transition of water flow from a water source into a ditch or from a ditch. In addition, a liner section in the form of a splitter is provided. A splitter section permits rerouting the flow of water in different directions through a ditch lined with the apparatus of the present invention. A splitter section also allows direction and redirection of water flow through one or more ditches despite a wide range of changes in water flow direction. Also, a diverter section is included for diverting water from one flow direction through the ditch to a point or area of application of the water.

An adaptor also is included in a preferred embodiment of the present invention. An adaptor may be used to connect incompatible liner sections. As used in this document, the term "incompatible liner sections" means that one or more locking channels of one or more liner sections to be positioned in a ditch are not snappably engageable with another locking channel because both are male locking channels, or both are female locking channels. This incompatibility of locking channels may occur due to the configuration of a ditch or system of ditches, or because the combinations and permutations of various liner sections used to construct a system for transporting water through a ditch or system of ditches interposes incompatible locking channels. The problem of incompatible locking channel segments is solved by use of an adaptor. The adapter is formed of at least three locking channel segments to accommodate interconnection of the incompatible locking channel segments.

The present invention, therefore, is useful for forming a system for transporting water through a ditch that substantially eliminates water seepage, is sufficiently lightweight to be easily assembled and placed into an earthen ditch, and may be disassembled for relocation, repair, or other purpose, yet remains fixed in the ditch during operation and use.

Figure 1:
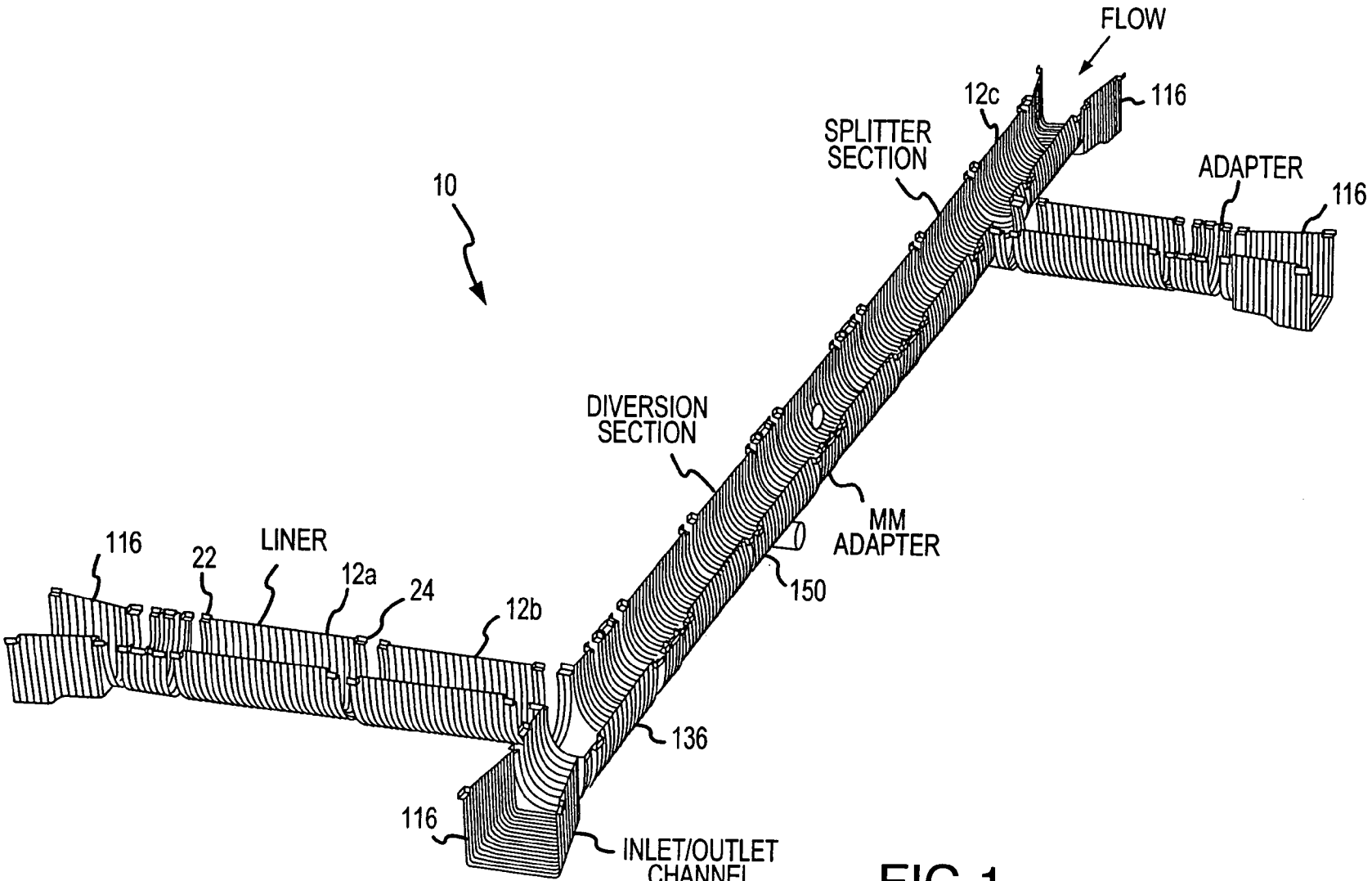
FIG. 1 is a perspective view of the apparatus and method for lining ditches in an operative environment within an earthen ditch.

FIG. 1 shows the apparatus for lining ditches in an operative configuration. Referring initially to FIG. 1, the apparatus for lining ditches is shown and generally designated 10. As shown by cross-reference between FIGS. 1 and 2, an apparatus for lining ditches is provided that, in its broadest context, includes a plurality of substantially polyethylene ditch liner sections 12 formed with a series of corrugations 18. Each of ditch liner sections 12*a,b* is designed to be assembled by snapping together opposing ends 14*a,b* of ditch liner sections 12 as shown by cross-reference between FIGS. 1 and 2. A sealant 16, preferably one does not bond with the material from which ditch liner sections 12*a,b*, are made may also be included. Sealant 16 is best shown diagrammatically in FIG. 3C by the dark line between the ditch liner sections.

Figure 2A:
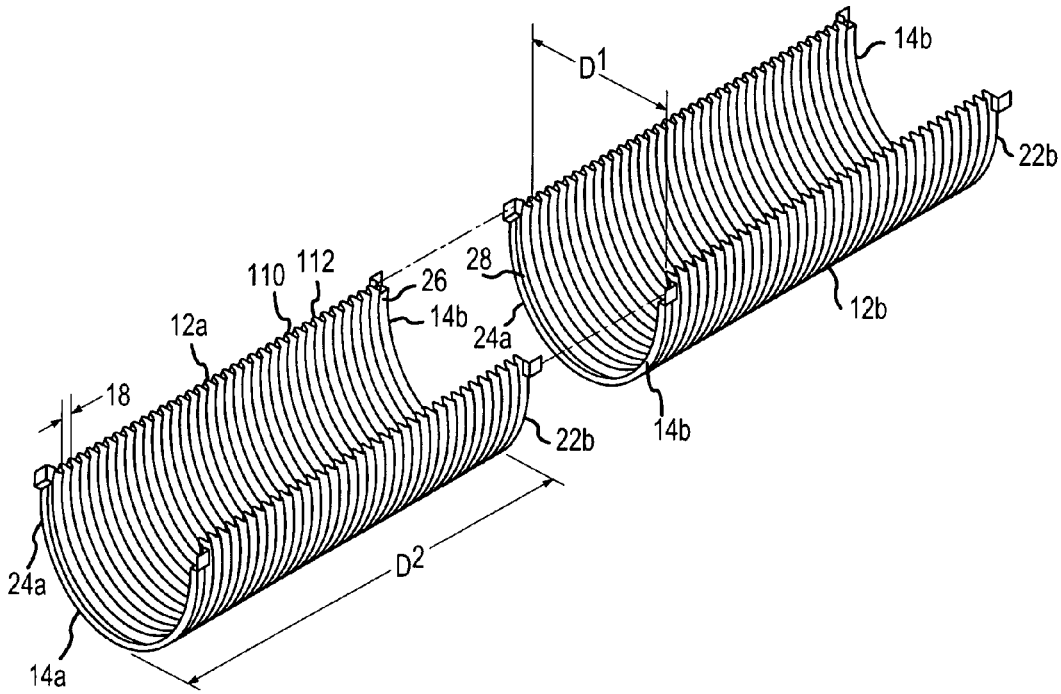
FIG. 2A is a perspective view of two ditch liners in accordance with the present invention.
Figure 2B:
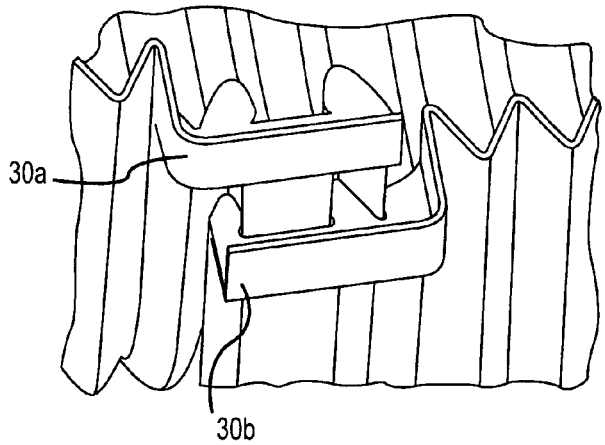
FIG. 2B is a perspective view of the handle assemblies of the present invention.

More specifically, apparatus for lining ditches 10, in a preferred embodiment of the present invention, includes plurality of substantially corrugated polyethylene ditch liner sections 12 (collectively, "liner sections," and individually, "liner section"). Although dimensions of liner sections 12*a,b* are not a material consideration in connection with the present invention, in a preferred embodiment of the present invention each liner section 12*a,b* as shown by cross-reference between FIGS. 1–2 is formed with a maximum diameter of 36" across corrugated sections, shown as $D^1$. The length $D^2$ of each liner section in a preferred embodiment is 5' 6", with 2.5". The corrugations contribute to making each individual liner section, and an interconnected ditch liner system, flexible yet at the same time capable of maintaining shape during operation. The corrugations also temporarily trap accumulated sediments for retrieval or ultimate removal. As will be evident to one skilled in the art, the lengths and widths of liner sections may be varied during the process of manufacturing to accommodate a wide range of sizes and dimensions of ditches in which liner sections 12*a,b* are deployed. In the preferred embodiment of the present invention, liner sections are manufactured through rotational molding processes to achieve the monolithic construction of the interrelated elements and components of the present invention.

Also, in a preferred embodiment of the present invention, liner sections 12*a,b* are formed of Medium Density Polyethylene ("MDPE") material. Although material used in the manufacture of one or more liner sections 12*a,b* is not a material consideration or limitation of the present invention, in a preferred embodiment of the present invention liner sections 12*a,b* and related liner sections and components of the system for transporting water through ditches are manufactured of medium to high density polyethylene or other thermoplastic materials. At least one advantage of the polyethylene or other thermoplastic materials is that such materials are unpalatable to rodents that otherwise might bore holes through the liner sections. Yet another advantage of the thermoplastic material is that bum tests indicate the material is highly resistant to heat and fire, a significant advantage given the propensity of property owners to bum rubbish and grasses adjacent ditches. Such materials also contribute to the flexibility, lightness, and environmental usefulness of the system. At least one commercial formulation of the polyethylene is provided by Nova Chemical NOVAPOL™, Serial No. TR-0535-UGhexene MDPE.

In a preferred embodiment of the present invention, liner section 12 is formed with a distal end 22 and a proximal end 24. As perhaps best shown by cross-reference between FIGS. 2 and 3A–3C, a first locking channel segment 26 is monolithically formed adjacent distal end 22 of liner sections 12*a,b*. In addition, a second locking channel segment 28 is monolithically formed adjacent proximal end 24 of liner sections 12*a,b* for snapable interconnection between first locking channel segment 26 and second locking channel segment 28. A plurality of handle assemblies 30*a,b* also are monolithically formed in liner sections 12*a,b* as best show in FIG. 2B. In a preferred embodiment of the present invention, plurality of handle assemblies 30*a,b* are formed substantially adjacent first locking channel segment 26 and second locking channel segment 28. As will be evident to one skilled in the art, the location of plurality of handle assemblies 30*a,b* is not a material limitation of the present invention. Plurality of handle assemblies 30*a,b* serves at least two functions, contributing to ease in porting liner sections 12*a,b* from one location to another, and for contributing to securing installation and deployment of liner sections 12*a,b* in a ditch as described below. In addition, at least one hole 32 is formed in plurality of handle assemblies 30*a,b* for removable insertion of a 34 rod for securing the one or more liner sections 12*a,b* to a ditch. Because at least one hole 32 may be formed in any or all handles assemblies 30 provided for in this document, an example of at least one such hole 32*a* is shown only in handles assembly 30 in FIG. 4A. In a preferred embodiment of the present invention, rod 34 used to secure the one or more liner sections 12*a,b* is preferably a number three (#3) rebar. Appropriate lengths of rebar may be installed through at least one hole 32 formed in a handle assembly 30 for insertion into adjacent earth. As will be evident to one skilled in the art, the dimensions of rod 32 are not a material limitation on the present invention.

Figure 3A:
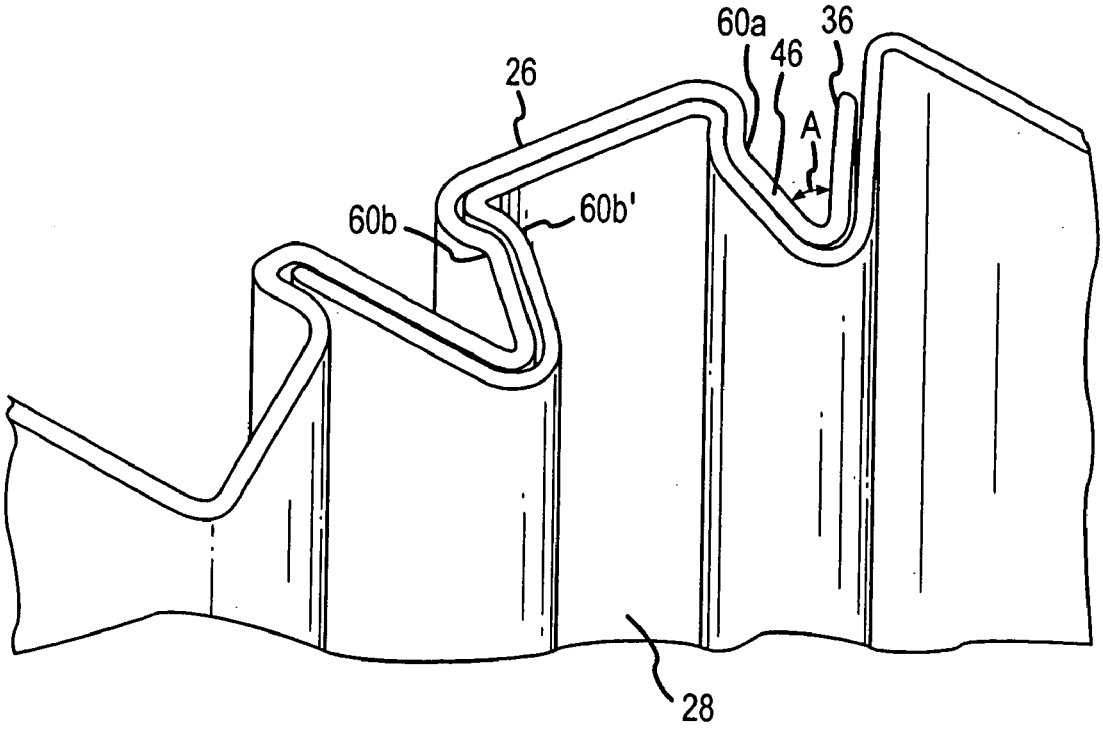
FIG. 3A is a perspective view of the first locking channel segment and the second locking channel segment, according to the present invention, snapped together.
Figure 3B:
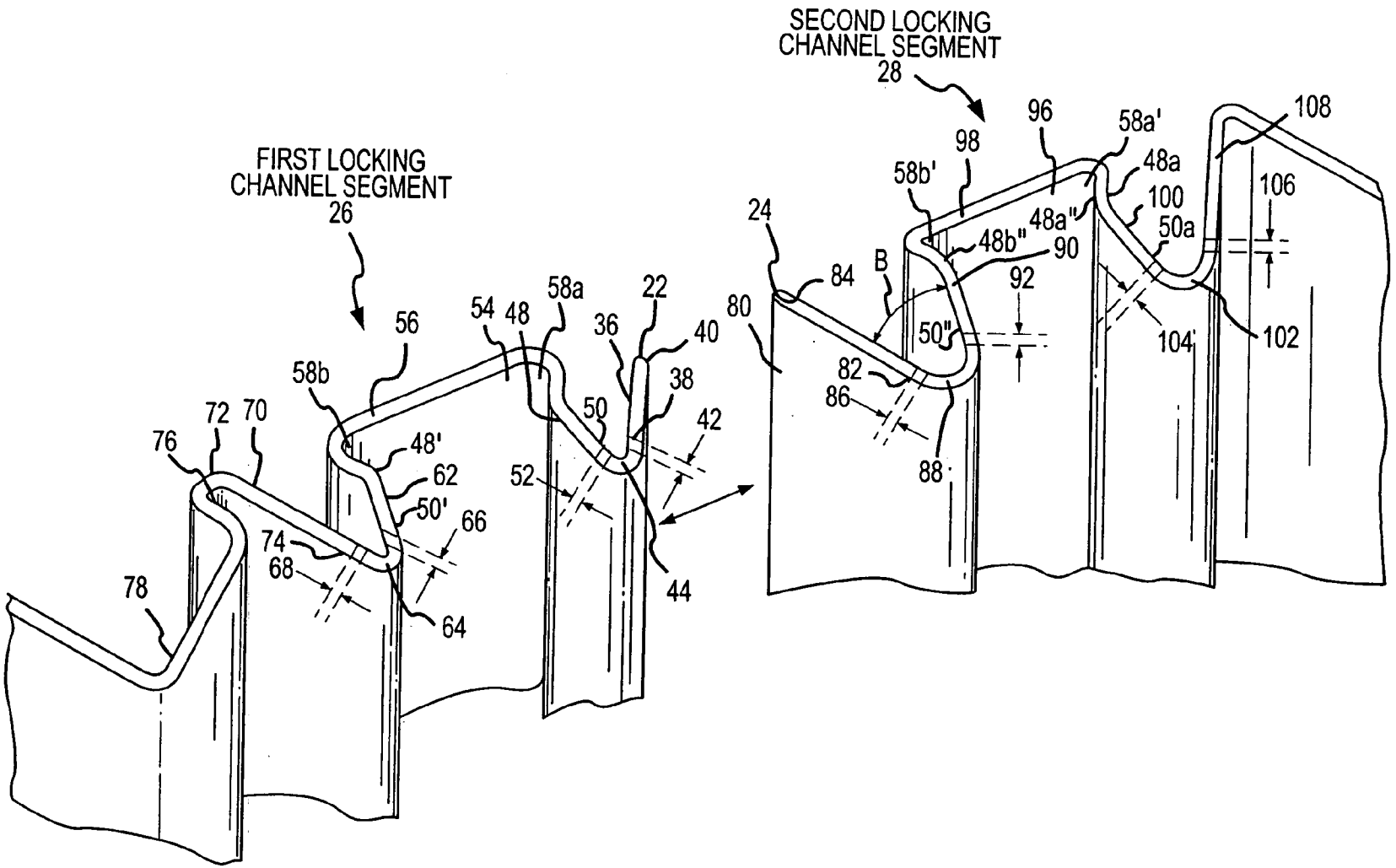
FIG. 3B is a perspective view of the first locking channel segment and the second locking channel segment separated from one another.
Figure 3C:
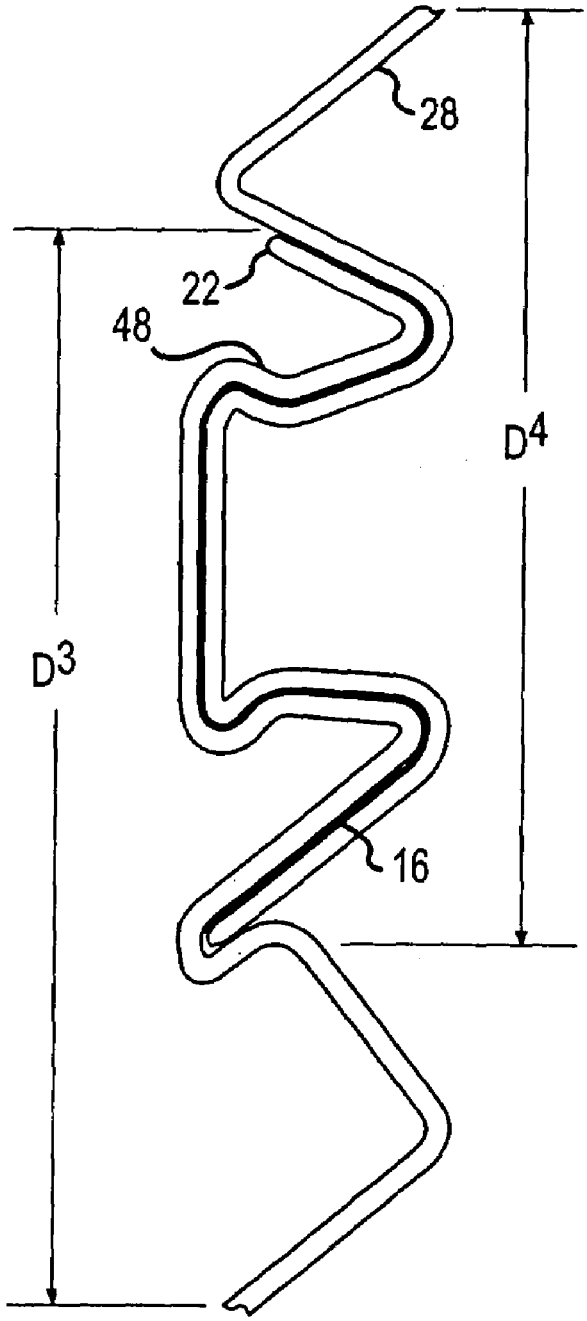
FIG. 3C is an end view of the first locking channel segment and the second locking channel segment snapped together.
Figure 4A:
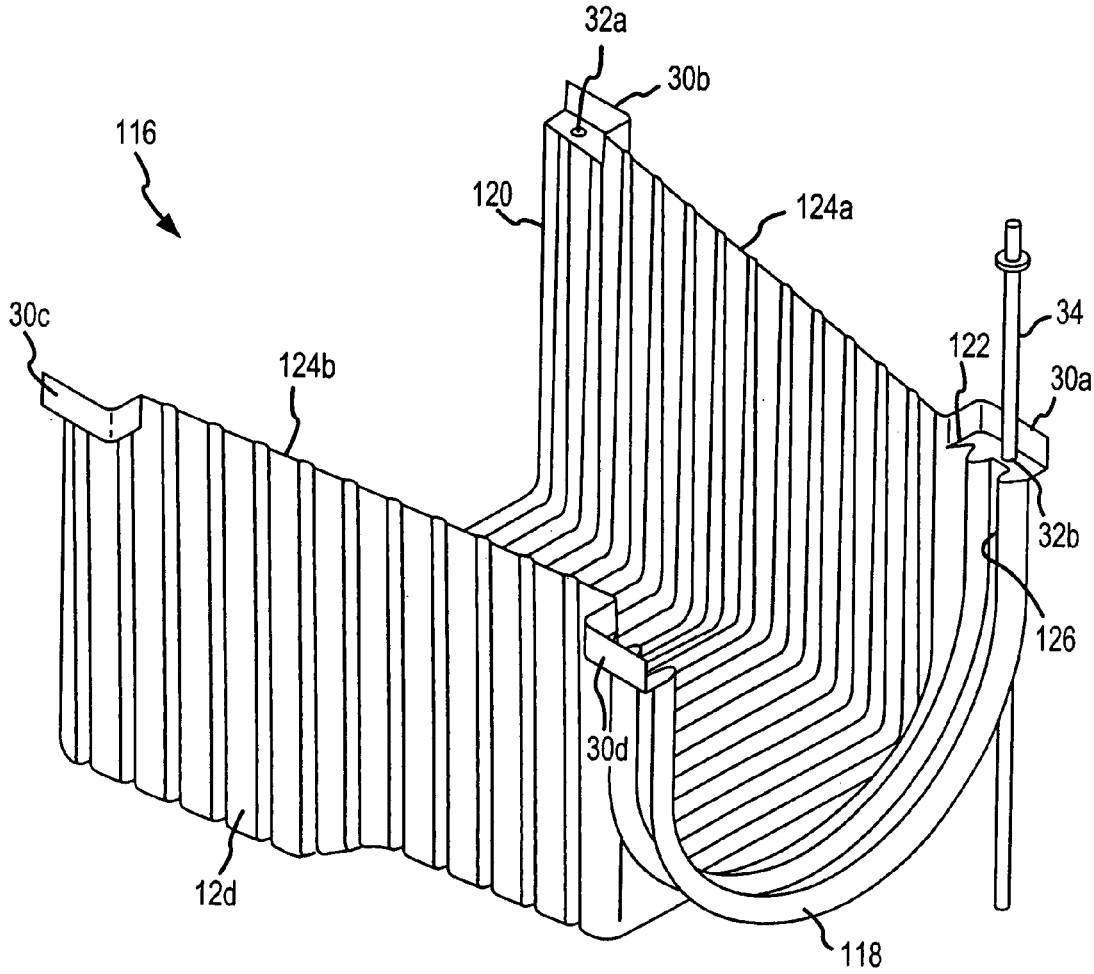
FIG. 4A is a perspective view of an inlet/outlet box according to the present invention.
Figure 4B:
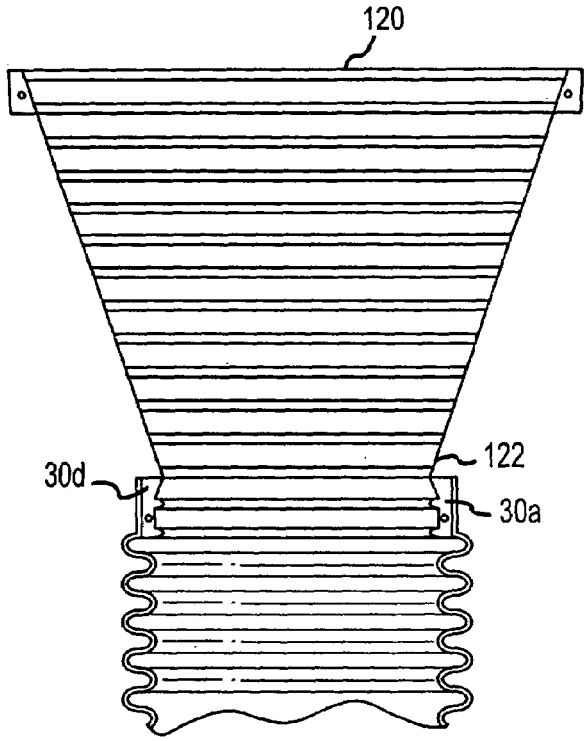
FIG. 4B is a side view of the inlet/outlet box.
Figure 4D:
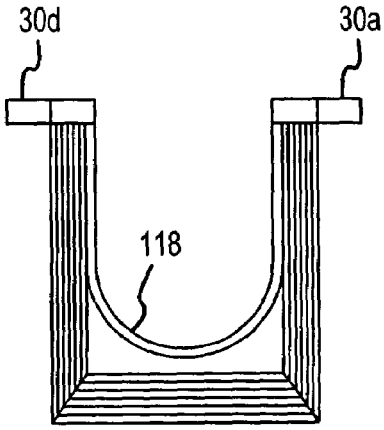
FIG. 4D is a front view of the inlet/outlet box.

In a preferred embodiment of the present invention, as best shown by cross-reference between FIGS. 3A–3C, first locking channel segment 26 is monolithically formed in distal end 22 of liner sections 12*a*. First locking channel segment 26 extends inwardly radially from distal end 22 of liner sections 12*a* a predetermined distance $D^3$ from distal end 22 of liner section 12*a*. First locking channel segment 26 includes a first flange 36. First flange 36 is formed with an anterior end 38 and a posterior end 40. Anterior end 38 of first flange 36 is monolithically connected to a first arm extension 42 of a first curved notch member 44. A first leg 46 also is included in first locking channel segment 26, formed with a leading end 48 and a following end 50. First leg 46 is monolithically connected to a second arm extension 52 of first curved notch member 44. An acute angle is formed between first flange 36 and first arm extension 42, with the first curved notch member 44 forming the apex of the acute angle. The acute angle is best shown by reference to FIG. 3A as Angle A. First locking channel segment 26 also includes a first duct 54 monolithically formed with a first beam 56 having opposing substantially semicircular grooves 58*a,b*. Opposing substantially semicircular grooves 58*a,b* have recessed ends 60*a,b*. One of recessed ends 60*a,b* is monolithically connected to leading end 48 of first leg 46. First locking channel segment 26 also includes a second leg 62 monolithically connected to the other of the opposing substantially semicircular grooves 58*b*. Second leg 62 also includes a leading end 48' and a following end 50'. Following end 50' of second leg 62 is connected monolithically to a second curved notch member 64 formed with a third arm extension 66 and a fourth arm extension 68. Following end 50' of second leg 62 is monolithically connected to third arm extension 66 of second curved notch member 64. In addition, first locking channel segment 26 includes a finger 70 formed monolithically in first locking channel 26 with a fore end 72, an aft end 74, and a slot 76 in fore end 72. A first shoulder 78 extends monolithically from fore end 72 of finger 70, the first shoulder 78 also forming part of one of the series of corrugations 18 in liner section 12*a*.

As also shown by cross-reference between FIGS. 3A–3C, in a preferred embodiment of the present invention, liner sections 12*b* includes second locking channel segment 28. Second locking channel segment 28 is monolithically formed in proximal end 24 of liner section 12*b*. Second locking channel segment 28 extends inwardly radially from proximal end 24 of liner section 12 a predetermined distance $D^4$ from proximal end 24 of liner section 12*b*. Second locking channel segment 28 includes a second flange 80. Second flange 80 is formed with an anterior end 82 and a posterior end 84. Anterior end 82 of second flange 80 is monolithically connected to a fifth arm extension 86 of a third curved notch member 88. A third leg 90 also is included, formed with a leading end 48" and a following end 50". Third leg 90 is monolithically connected to a sixth arm extension 92 of third curved notch member 88. An acute angle is formed between second flange 80 and third leg 90, and third curved notch member 88 forms the apex of the acute angle. The acute angle is best shown by reference to FIG. 3B as Angle B. Second locking channel segment 28 also includes a second duct 96 formed with a second beam 98 having opposing substantially semicircular grooves 58*a'b'*. Opposing substantially semicircular grooves 58*a',b'* have recessed ends 60*a',b'*. One of recessed ends 60*a'* is monolithically connected to leading end 48" of third leg 90. Second locking channel segment 28 also includes a fourth leg 100 monolithically connected to the other of the opposing substantially semicircular grooves 58*a'*. Fourth leg 100 also includes a leading end 48*a* and a following end 50*a*. Following end 50*a* of fourth leg 100 is connected monolithically to a fourth curved notch member 102 formed with a seventh arm extension 104 and eighth arm extension 106, and following end 50*a* of fourth leg 100 is monolithically connected to seventh arm extension 104 of fourth curved notch member 102. A second shoulder 108 extends monolithically from the eighth arm extension 106 of fourth curved notch member 102.

As will be evident to one skilled in the art, the length of first beam 56 between opposing substantially semicircular grooves 58*a,b* of first duct 54 formed in first locking channel segment 26 exceeds the length of second beam 98 between opposing grooves 58*a',b'* of second duct 96 in second locking channel segment 28 to enable snapable lockable engagement between second locking channel segment 28 and first locking channel segment 26 by snapping first locking channel segment 26 and second locking channel segment 28 together. First curved notch member 44 in first locking channel segment 26 is formed for removable locking engagement with fourth curved notch member 102 of second locking channel segment 28, and second curved notch member 64 in first locking channel segment 26 is formed for removable locking engagement with third curved notch member 88 of second locking channel segment 28.

Testing and experimentation in connection with the present invention has established that a system of ditch liners formed from corrugated liner sections 12*a,b* provides more advantages than a system of liner sections limited to a liner formed from straight conduit sections. The term "corrugated" as used in this document refers to the shape of a liner section in the form or shape of wrinkles or folds that include alternating ridges 110 and alternating grooves 112 along the longitudinal axis extending the length $D^2$ of liner sections 12*a,b* as best shown in FIG. 2.

As also shown in FIG. 3C, a preferred embodiment of the present invention includes a sealant 16. Sealant 16 is shown diagrammatically as a dark area and legend in FIG. 3C. As will be evident to one skilled in the art, sealant 16 is not required to practice the present invention. Sealant 16 is chosen from among sealants that will not bond with material used to construct liner sections 12*a,b*. Sealant 16 therefore permits removable disassembly of one or more liner sections 12*a,b* that have been snapped together.

Figure 4C:
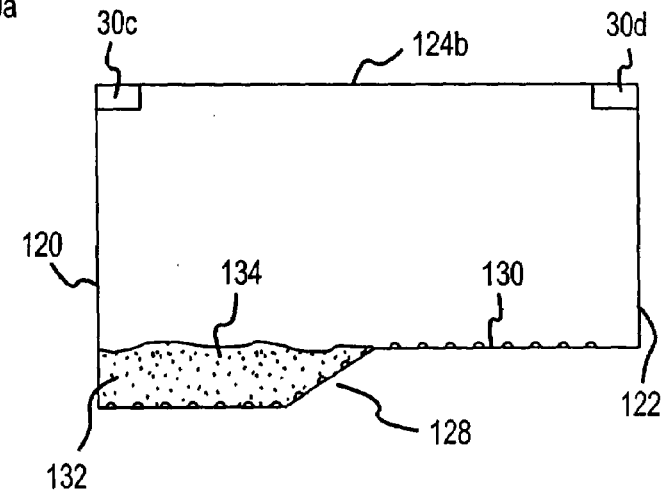
FIG. 4C is a top view of the inlet/outlet box.
Figure 5A:
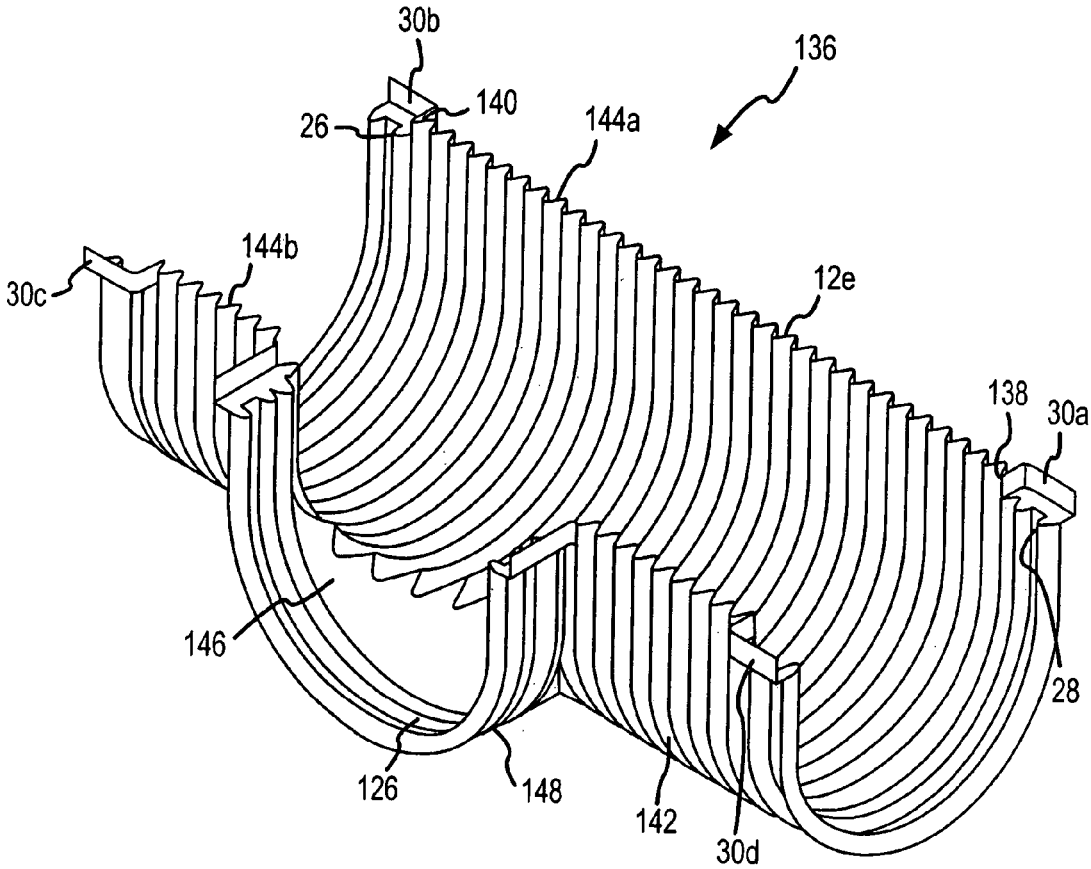
FIG. 5A is a perspective view of the splitter according to the present invention.
Figure 5B:
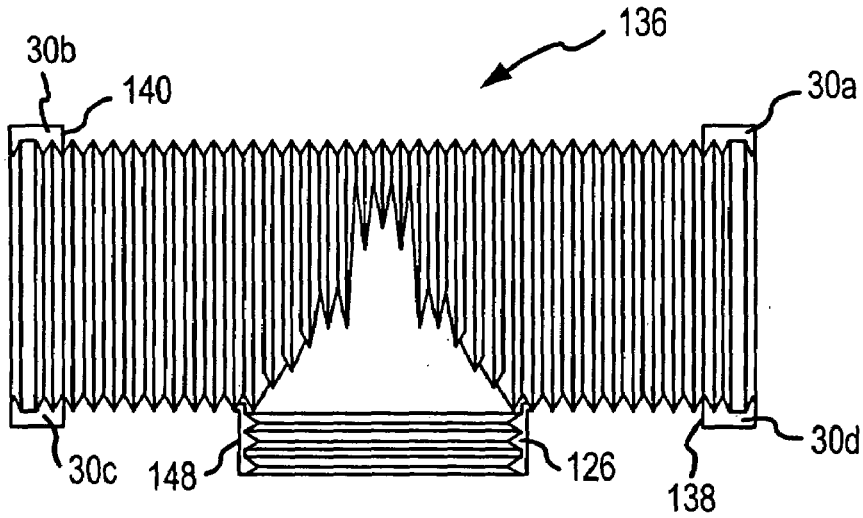
FIG. 5B is a side view of the splitter.
Figure 5C:
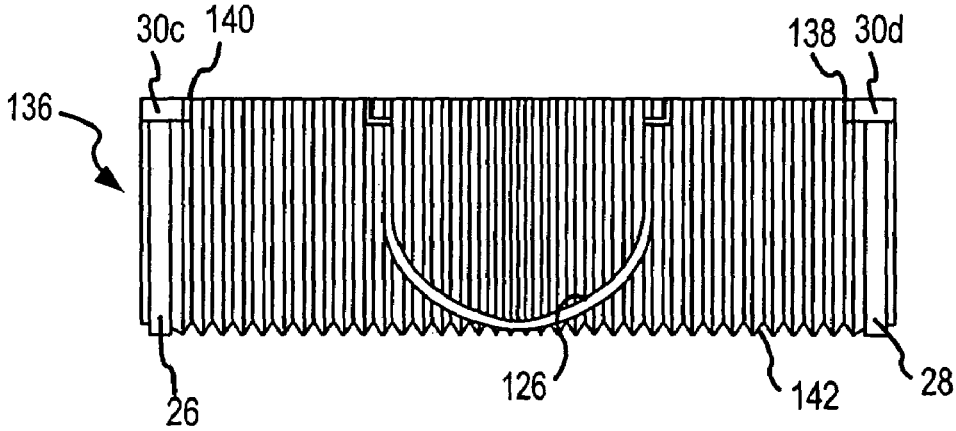
FIG. 5C is a top view of the splitter.
Figure 5D:
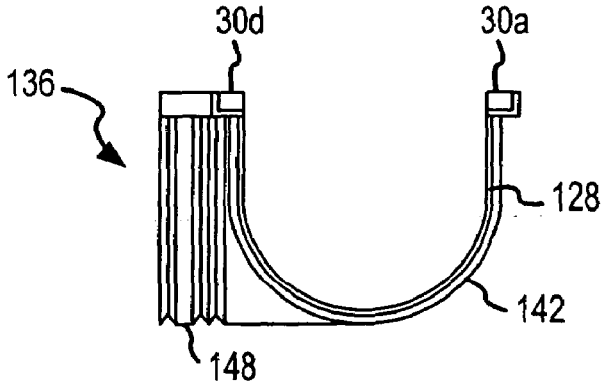
FIG. 5D is a front view of the splitter.
Figure 6A:
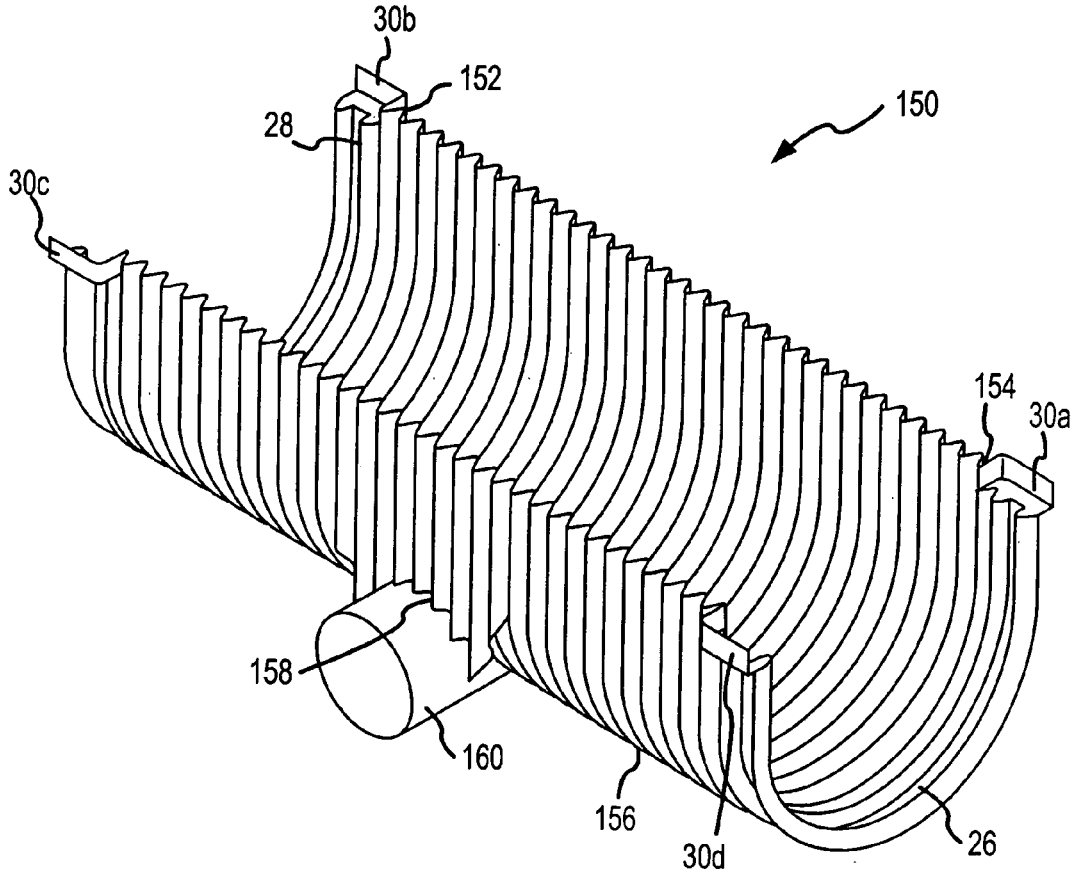
FIG. 6A is a perspective view of the diverter section according to the present invention.
Figure 6B:
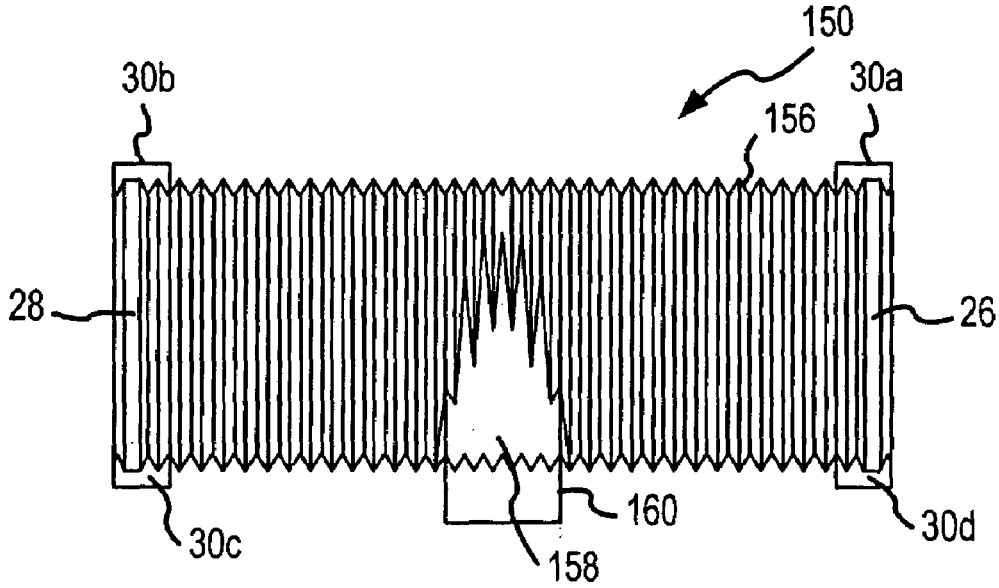
FIG. 6B is a side view of the diverter section.
Figure 6C:
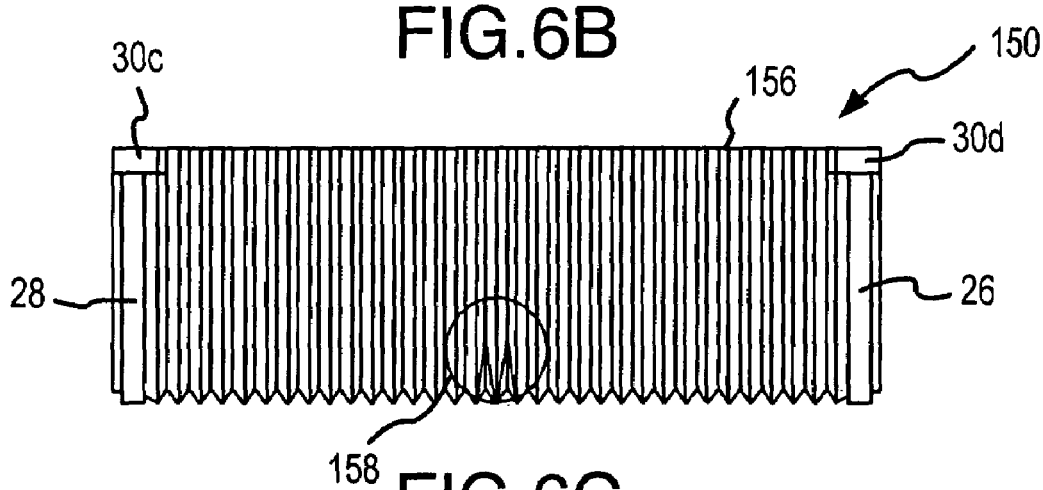
FIG. 6C is a top view of the diverter section.
Figure 6D:
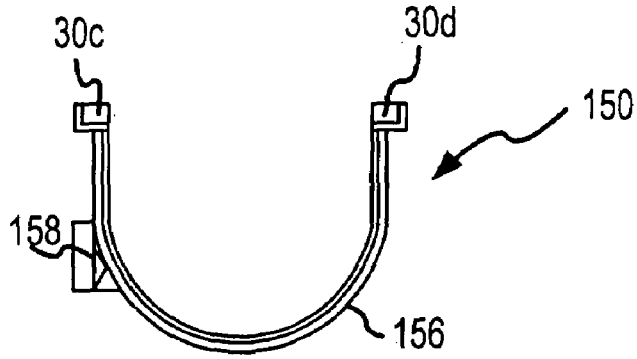
FIG. 6D is a front view of the diverter section.
Figure 7A:
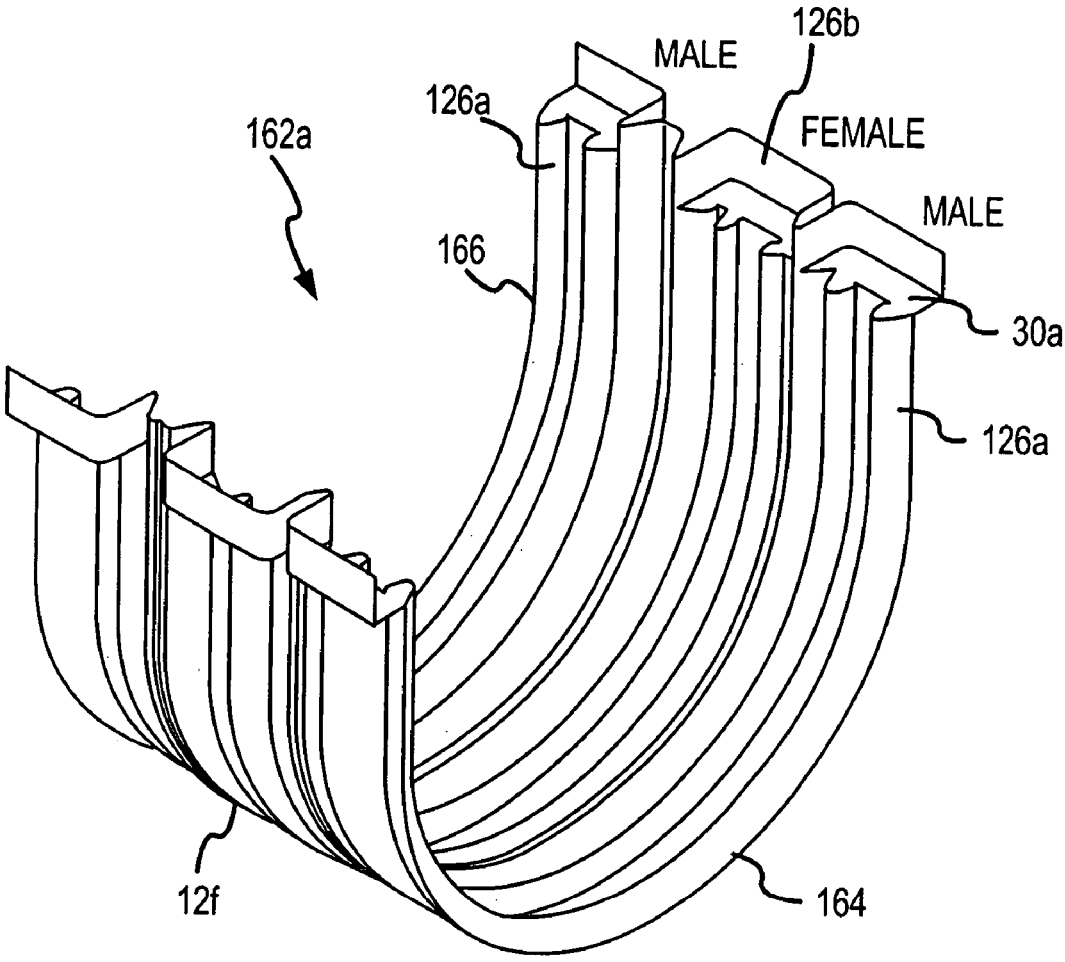
FIG. 7A is a perspective view of a male-female-male adaptor according to the present invention.
Figure 7B:
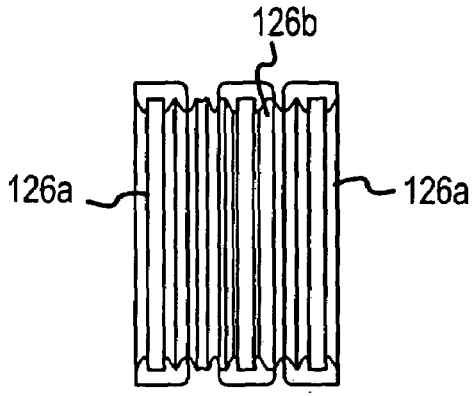
FIG. 7B is a side view of the male-female-male adaptor.
Figure 7C:
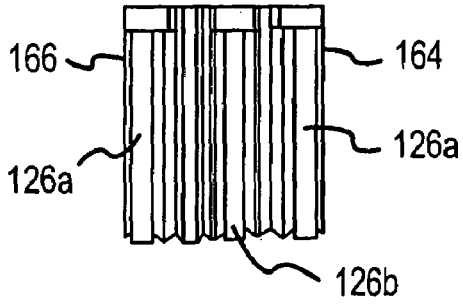
FIG. 7C is a top view of the male-female-male adaptor.
Figure 7D:
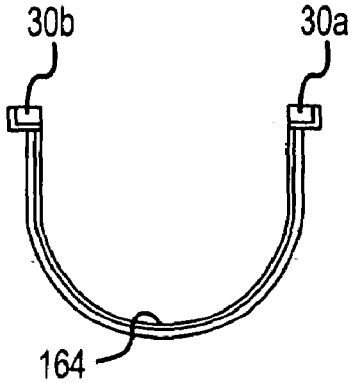
FIG. 7D is an end view of the male-female-male adaptor.
Figure 8A:
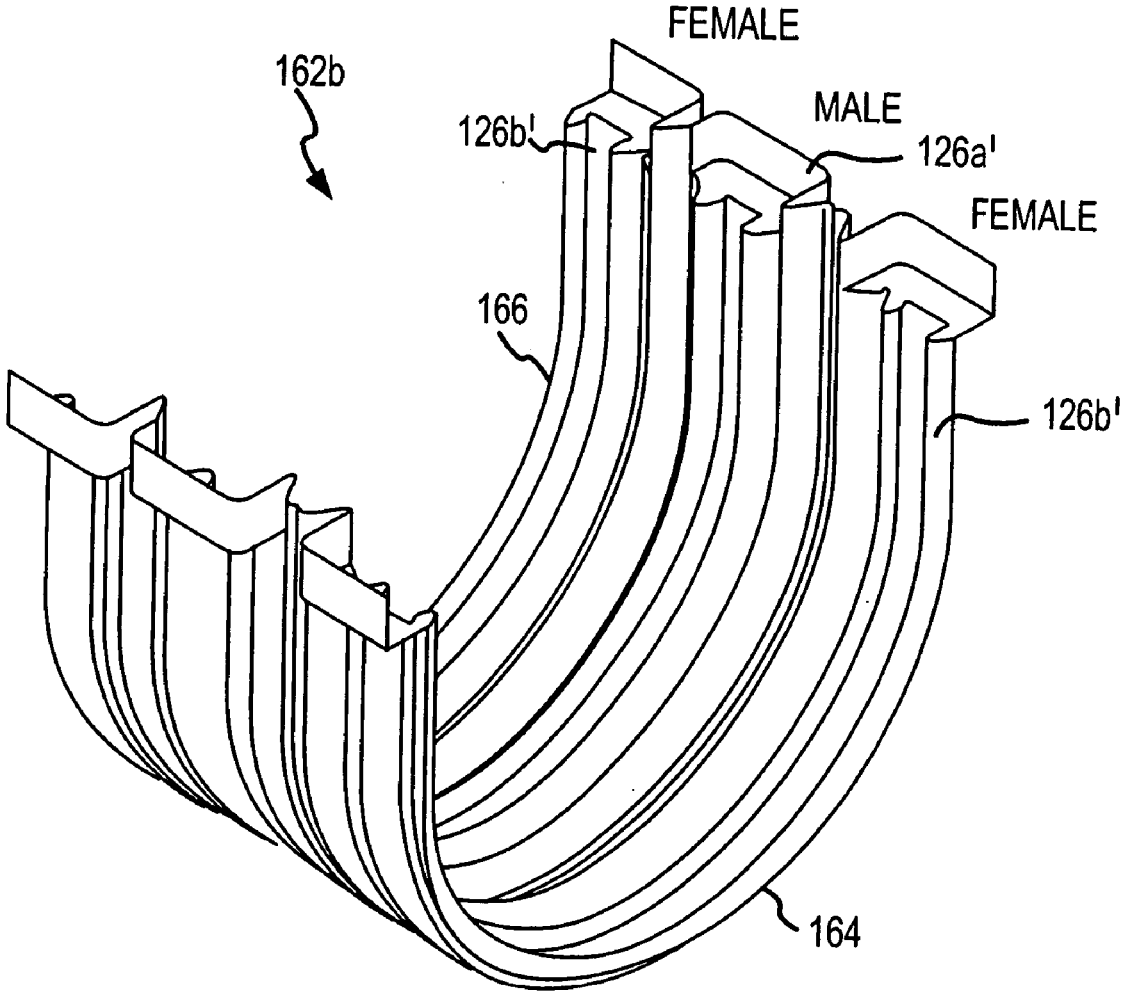
FIG. 8A is a perspective view of a female-male-female adaptor according to the present invention.
Figure 8B:
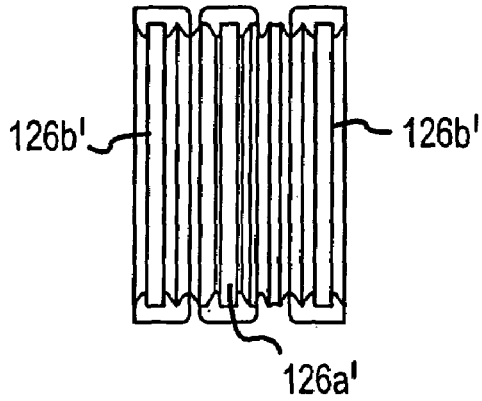
FIG. 8B is a side view of the female-male-female adaptor.
Figure 8C:
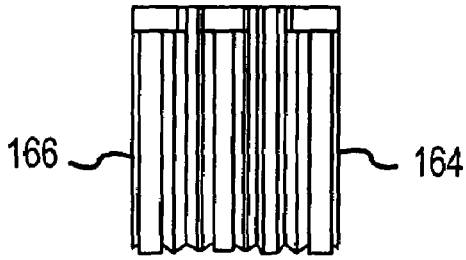
FIG. 8C is a top view of the female-male-female adaptor.
Figure 8D:
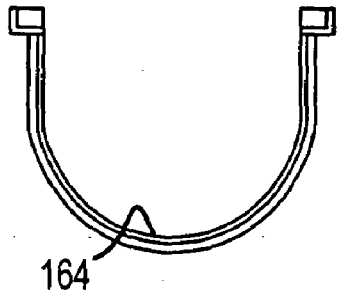
FIG. 8D is an end view of the female-male-female adaptor.

A preferred embodiment of the present invention also includes an inlet/outlet box 116, as perhaps best shown by cross-reference among FIGS. 4A-4D. Inlet/outlet box 116 is demountably engageable with at least one end of a liner section 12*c*, as best shown in FIG. 1. In a preferred embodiment of the present invention, liner section 12*c* is substantially semi-circular. Inlet/outlet box 116 is provided to make a smooth transition of water flow from a water source either into a ditch or from a ditch. Inlet/outlet box 116 is a liner section 12d having an attachment ring 118, an entrance end 120, an exit end 122, and opposing fins 124*a,b* therebetween. Exit end 122 is substantially semi-circular, while entrance end 120 is substantially rectangular. A locking channel segment 126 is monolithically formed adjacent exit end 122. In addition, opposing handle assemblies 30*a–d* are formed monolithically adjacent entrance end 120 and exit end 122. Opposing handle assemblies 30*a–d* include one or more holes 32*a,b* for slidable engagement with one or more rods 34. Means 128 for anchoring inlet/outlet box 116 within a ditch also is provided. In a preferred embodiment of the present invention, anchoring means 128 includes a floor 130 monolithically extending between opposing fins 124*a,b* adjacent exit end 122, and a recessed chamber 132 monolithically extending between opposing fins 124*a,b* adjacent entrance end 120. In a preferred embodiment of the present invention, as shown in FIG. 4C, means 128 for anchoring also includes use of concrete 134, or a similar material. Concrete 134, or a similar material, may be installed within recessed chamber 132 and cured. The weight of concrete 134 helps hold inlet/outlet channel 116 in place within a ditch.

As best shown by cross-reference among FIGS. 5A–5D, a preferred embodiment of the present invention also includes a splitter section 136, also called a splitter. Splitter section 136 permits a user to reroute the flow of water in different directions through a ditch lined with the apparatus of the present invention. Splitter section 136 also allows direction and redirection of water flow through one or more ditches despite a wide range of changes in water flow direction. As best shown by cross-reference among FIGS. 5A–5D, splitter section 136 includes a liner section 12*e* having a leading end 138, a following end 140, and a substantially corrugated first chute 142 therebetween. Preferably, liner section 12*e* is substantially semi-circular. First chute 142 is formed with opposing edges 144*a,b*. Substantially corrugated first chute 142 is formed with a passage 146. Substantially semi-circular passage 146 is formed through at least one of opposing edges 144*a,b*. A first locking channel segment 26 is monolithically formed adjacent following end 140 of liner section 12*e*. A second locking channel segment 28 is monolithically formed adjacent leading end 138 of liner section 12*e*. In addition, a drain 148 is monolithically mounted adjacent passage 146 which, in a preferred embodiment of the present invention, is substantially semi-circular. Drain 148 is formed to include a locking channel segment 126 for detachably connecting drain 148 to another locking channel segment (not shown).

As perhaps best shown by cross-reference among FIGS. 6A–6D, the present invention also includes a diversion section 150. Diversion section 150 is included for diverting water from one flow direction through a ditch to a point or area of application of the water. Diversion section 150 is formed with a trailing end 152, an advance end 154, and a substantially corrugated second chute 156. In addition, an opening 158 is formed through substantially corrugated second chute 156. A hollow cylinder member 160 monolithically is mounted over opening 158. Opening 158 and hollow cylinder member 160 are formed monolithically in substantially corrugated second chute 156. In a preferred embodiment of the present invention, diversion section 150 includes one or more handle assemblies 30*a–d* formed adjacent trailing end 152 and advance end 154 of substantially corrugated second chute 156. In addition, a first locking channel segment 26is monolithically formed adjacent trailing end 152 of diversion section 150. A second locking channel segment 28is monolithically formed adjacent advance end 154 of diversion section 150.

One or more adaptors 162*a,b* also are included in a preferred embodiment of the present invention, as shown by cross-reference among FIGS. 7A–7D and 8A–8D. Adaptors 162*a,b* may be used to connect incompatible liner sections 12. Adaptor 162*a* is formed of one or more locking channel segments 126, and in a preferred embodiment include at least three locking channel segments 126*a*, 126*b*, and 126*a* to accommodate interconnection of the incompatible locking channel segments. In a preferred embodiment of the present invention, adaptor 162*a,b* are formed as a liner section 12*f* having a forward end 164 and a back end 166. At least three locking channel segments 126 include at least two similar locking channel segments 126*a* monolithically formed adjacent forward end 164 and back end 166 of liner section 12*f*, and a dissimilar locking channel segment 126*b* is included between at least two similar locking channel segments 126*a*. Adaptor 162 may also include one or more handle assemblies 30 monolithically mounted on at least two similar locking channel segments 126*a*. As shown in FIG. 8A–8D, adaptor 162*b* is formed of one or more locking channel segments 126, and in a preferred embodiment include at least three locking channel segments 126*b*, 126*a*, and 126*b* to accommodate interconnection of the incompatible locking channel segments. In a preferred embodiment of the present invention, adaptor 162*b* is formed as a liner section 12*f* having a forward end 164 and a back end 166. At least three locking channel segments 126 include at least two similar locking channel segments 126*b* monolithically formed adjacent forward end 164 and back end 166 of liner section 12*f*, and a dissimilar locking channel segment 126*a* is included between at least two similar locking channel segments 126*b*. Adaptor 162 may also include one or more handle assemblies 30 monolithically mounted on at least two similar locking channel segments 126*b*.

In operation, tools required for field installation of a liner system in accordance with the present invention are common and minimal. Thus, installation may be achieved using only a rubber mallet, a carpenter's hammer, a carpenter's level, a shovel, and a sledge hammer.

Assembly of liner sections 12*a–f* into a system for transporting water in a ditch may be accomplished outside a ditch, lateral or other water transportation system. Assembly on the bank of a ditch allows for easier installation, easier interconnection of the first locking channel segment 26 and second locking channel segment 28 of, for example, liner sections 12*a,b*. In addition, assembly of liner sections 12*a,b* outside a ditch enables inspection of surfaces and the nestable interconnections. Interconnection of first locking channel segment 26 and second locking channel segment 28 may be achieved merely by applying pressure against second locking channel segment 28 for detachably locking with first locking channel segment 26.

After a desirable number of liner sections 12 have been assembled and interconnected, the assembled system may be moved into a ditch by grasping handle assemblies 30 and relocating the assembled liners 12. Once in a ditch interconnected liner sections 12*a,b* may be pulled, stretched and otherwise configured to remove any slack, and to ensure ridged installation as a unit without low spots. A conventional carpenter's level is useful for confirming a reasonable slope. In a preferred embodiment of the present invention, in operation, a slope of 0.50% is recommended. Optimal slope is between 1% and 2%. Because of the unique method for lockable interconnection of first locking channel segment 26 with second locking channel segment 28 as disclosed in this document, the installation of one or more inlet/outlet channels 116, one or more splitter sections 136, one or more diversion sections 136, and any number of adaptors 162, can be accomplished quickly, easily, and in any number of configurations.

While the apparatus and method for lining ditches shown in drawing FIGS. 1–8D is one embodiment of the present invention, it is in fact merely one embodiment of the invention, is not intended to be exclusive, and is not a limitation of the present invention. While the particular apparatus and method for lining ditches as shown and disclosed in detail in this instrument is fully capable of obtaining the objects and providing the advantages stated, this disclosure is merely illustrative of the presently preferred embodiments of the invention, and no limitations are intended in connection with the details of construction, design or composition other than as provided and described in the appended claims. Claim elements and steps in this document have been numbered solely as an aid in readability and understanding. The numbering is not intended to, and should not be considered as, intending to indicate the ordering or sequencing of elements and steps in the following claims.

What is claimed is:

1. In a system for transporting water through a ditch, an inlet/outlet box comprising:

a liner section having an entrance end, an exit end, and opposing fins therebetween;

a locking channel segment monolithically formed substantially adjacent the exit end;

opposing handle assemblies formed monolithically adjacent the entrance end and the exit end; and means for anchoring the inlet/outlet box, wherein the anchoring means includes a floor monolithically extending between the opposing fins adjacent the exit end, and a recessed chamber monolithically extending between the opposing fins adjacent the entrance end.

2. In a system for transporting water through a ditch, an inlet/outlet box as recited in claim 1, wherein the liner section is substantially semi-circular in cross-section.

3. In a system for transporting water through a ditch, an inlet/outlet box as recited in claim 1, wherein the exit end is substantially semi-circular in cross-section.

4. In a system for transporting water through a ditch, an inlet/outlet box as recited in claim 1, wherein the entrance end is substantially rectangular in cross-section.

5. In a system for transporting water through a ditch, an inlet/outlet box as recited in claim 1, wherein the opposing handle assemblies include one or more holes for slidable engagement with a rod.

* * * * *